US008983355B2

(12) United States Patent
Numao

(10) Patent No.: US 8,983,355 B2
(45) Date of Patent: Mar. 17, 2015

(54) IMAGE FORMING APPARATUS AND IMAGE FORMING METHOD

(75) Inventor: Kazunori Numao, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 90 days.

(21) Appl. No.: 13/613,292

(22) Filed: Sep. 13, 2012

(65) Prior Publication Data

US 2013/0251431 A1 Sep. 26, 2013

(30) Foreign Application Priority Data

Mar. 23, 2012 (JP) ..... 2012-067078

(51) Int. Cl.
*G03G 15/20* (2006.01)
*G03G 15/00* (2006.01)

(52) U.S. Cl.
CPC .. *G03G 15/6585* (2013.01); *G03G 2215/00805* (2013.01)
USPC ..... 399/341

(58) Field of Classification Search
CPC ..... G03G 15/2078; G03G 2215/00805; G03G 2216/00801; G03G 15/6582
USPC ..... 399/69, 341, 342
See application file for complete search history.

(56) References Cited

U.S. PATENT DOCUMENTS

2011/0038655 A1* 2/2011 Ng et al. ..... 399/341
2011/0081608 A1* 4/2011 Yaguchi et al. ..... 430/105

FOREIGN PATENT DOCUMENTS

JP 09-090701 A 4/1997

* cited by examiner

*Primary Examiner* — Hoang Ngo
(74) *Attorney, Agent, or Firm* — Sughrue Mion, PLLC

(57) ABSTRACT

An image forming apparatus includes an image carrier that carries a first toner image, a transfer unit that transfers the first toner image on the image carrier onto a recording medium directly or through an intermediate transfer body, a fixing unit that fixes the first toner image that has been transferred onto the recording medium, and a glossiness-controlling unit that forms a second toner image made of clear toner on the recording medium in accordance with an amount of toner that forms the first toner image to be transferred onto the recording medium, thereby controlling a glossiness on a surface of the recording medium that has been subjected to the fixing performed by the fixing unit.

4 Claims, 10 Drawing Sheets

FIG. 12

Lut1

| TOTAL AMOUNT OF COLOR TONERS | AMOUNT OF FIRST CLEAR TONER |
|---|---|
| 0 | 100 |
| 50 | 100 |
| 100 | 100 |
| 150 | 90 |
| 170 | 70 |
| 200 | 40 |
| 240 | 0 |

FIG. 13

Lut2

| TOTAL AMOUNT OF COLOR TONERS | AMOUNT OF SECOND CLEAR TONER |
|---|---|
| 0 | 0 |
| 50 | 50 |
| 100 | 100 |
| 150 | 100 |
| 170 | 100 |
| 200 | 100 |
| 240 | 100 |

IMAGE FORMING APPARATUS AND IMAGE FORMING METHOD

CROSS-REFERENCE TO RELATED APPLICATIONS

This application is based on and claims priority under 35 USC 119 from Japanese Patent Application No. 2012-067078 filed Mar. 23, 2012.

BACKGROUND (i) Technical Field

The present invention relates to an image forming apparatus and an image forming method.

(ii) Related Art

An example of an image forming apparatus according to the related art forms a monochrome or full-color image by transferring a toner image formed on a photoconductor drum onto a recording medium with a transfer member and fixing the toner image. The transfer member transfers the toner image onto the recording medium directly or indirectly through an intermediate transfer belt.

SUMMARY

According to an aspect of the invention, there is provided an image forming apparatus including an image carrier that carries a first toner image, a transfer unit that transfers the first toner image on the image carrier onto a recording medium directly or through an intermediate transfer body, a fixing unit that fixes the first toner image that has been transferred onto the recording medium, and a glossiness-controlling unit that forms a second toner image made of clear toner on the recording medium in accordance with an amount of toner that forms the first toner image to be transferred onto the recording medium, thereby controlling a glossiness on a surface of the recording medium that has been subjected to the fixing performed by the fixing unit.

BRIEF DESCRIPTION OF THE DRAWINGS

An exemplary embodiment of the present invention will be described in detail based on the following figures, wherein:

FIG. 12 illustrates a look-up table used to determine the amount of first clear toner; and FIG. 13 illustrates another look-up table used to determine the amount of second clear toner.

DETAILED DESCRIPTION

An exemplary embodiment of the present invention will now be described with reference to the drawings.

Figure 1:
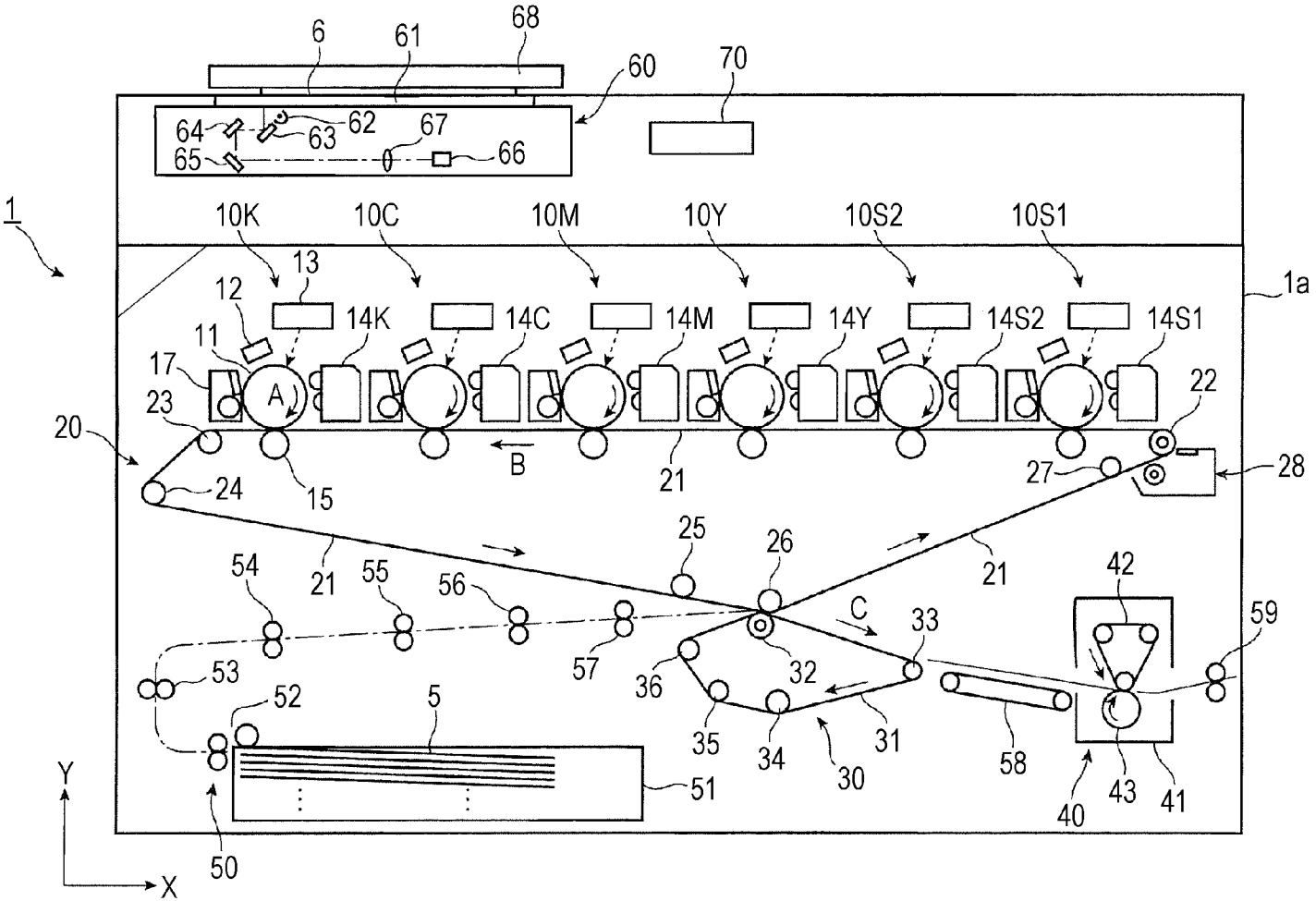
FIG. 1 illustrates the structure of an image forming apparatus according to an exemplary embodiment of the present invention.
Figure 2:
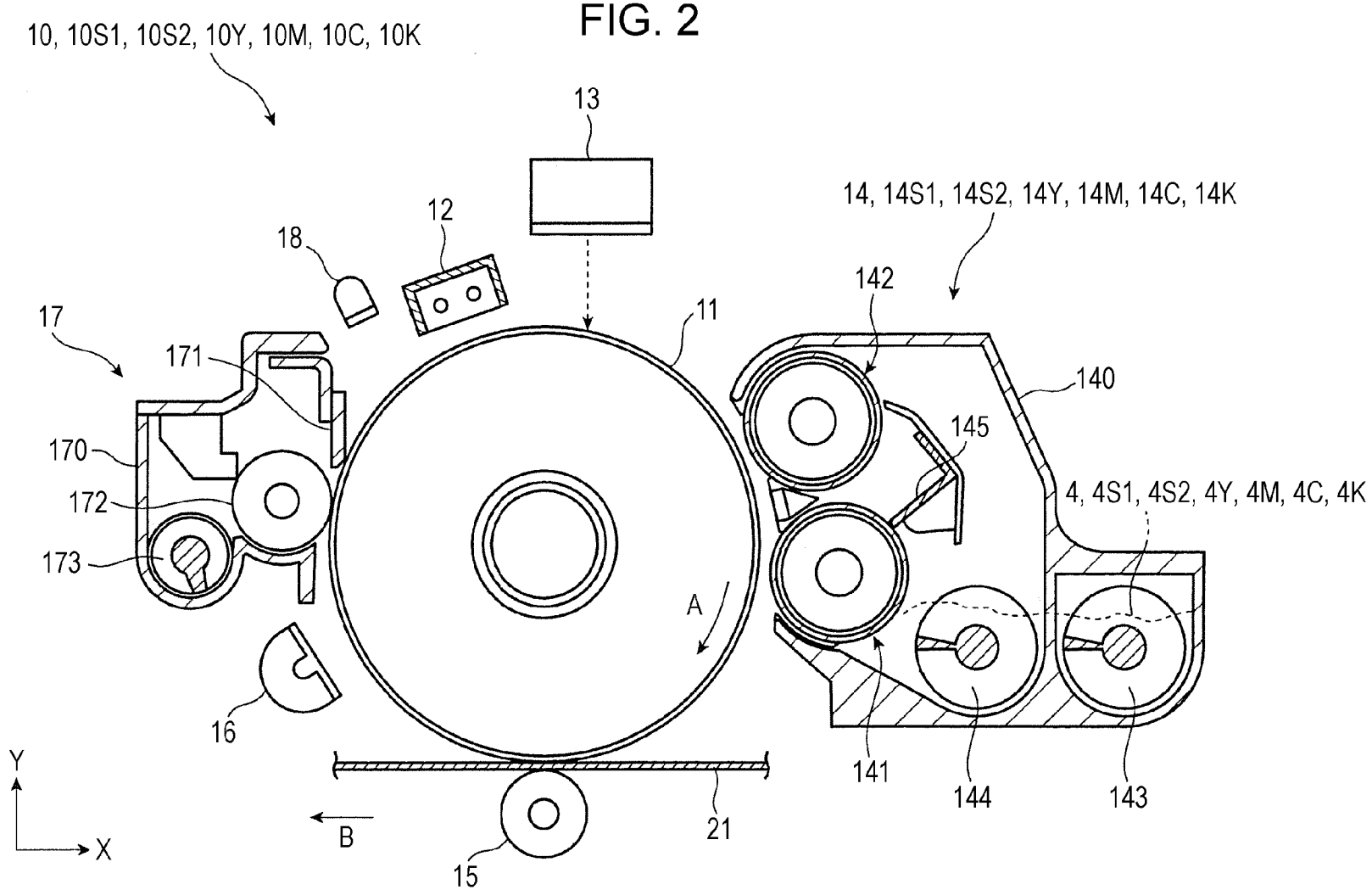
FIG. 2 illustrates the structure of a part of the image forming apparatus according to the exemplary embodiment of the present invention.

FIGS. 1 and 2 illustrate an image forming apparatus 1 according to the exemplary embodiment. FIG. 1 illustrates the overall structure of the image forming apparatus 1, and FIG. 2 illustrates an enlarged view of a part (for example, imaging devices) of the image forming apparatus 1.

Overall Structure of Image Forming Apparatus

The image forming apparatus 1 according to the exemplary embodiment is, for example, a color printer. The image forming apparatus 1 includes plural imaging devices 10, an intermediate transfer device 20, a paper feeding device 50, and a fixing device 40. Each imaging device 10 forms a toner image developed with toner contained in developer 4. The intermediate transfer device 20 carries toner images formed by the respective imaging devices 10 and transports the toner images to a second transfer position at which the toner images are transferred onto a sheet of recording paper 5, which is an example of a recording medium, in a second transfer process. The paper feeding device 50 contains and transports the sheet of recording paper 5 to be supplied to the second transfer position of the intermediate transfer device 20. The fixing device 40 fixes the toner images that have been transferred onto the sheet of recording paper 5 by the intermediate transfer device 20 in the second transfer process.

In the case where, for example, an image input device 60 that inputs a document image to be formed on the sheet of recording paper 5 is additionally provided, the image forming apparatus 1 may be configured as a color copier. Referring to FIG. 1, the image forming apparatus 1 includes a housing 1*a* including, for example, a supporting structural member and an external covering part. The one-dot chain line shows a transport path along which the sheet of recording paper 5 is transported in the housing 1*a*.

Structure of Part of Image Forming Apparatus

The imaging devices 10 include six imaging devices 10Y, 10M, 10C, 10K, 10S1, and 10S2. The imaging devices 10Y, 10M, 10C, and 10K respectively form toner images of four colors, which are yellow (Y), magenta (M), cyan (C), and black (K). The imaging devices 10S1 and 10S2 respectively form two types of toner images of special colors S1 and S2. The six imaging devices 10 (S1, S2, Y, M, C, and K) are arranged along a line in the inner space of the housing 1*a*. The developers 4 (S1 and S2) of the special colors (S1 and S2) contain, for example, materials of colors which are difficult or impossible to be expressed by the above-described four colors. More specifically, toners of colors other than the four colors, toners having the same colors as the four colors but saturations different from those of the toners of four colors, clear toners that increase the glossiness, foaming toners used in Braille printing, fluorescent toners, etc., may be used. The imaging devices 10 (S1, S2, Y, M, C, and K) have a substantially similar structure, as described below, except for the type of the developer used therein.

As illustrated in FIGS. 1 and 2, each imaging device 10 (S1, S2, Y, M, C, or K) includes a photoconductor drum 11 that rotates, and devices described below are arranged around the photoconductor drum 11. The devices include a charging device 12, an exposure device 13, a developing device 14 (S1, S2, Y, M, C, K), a first transfer device 15, a pre-cleaning charging device 16, a drum cleaning device 17, and a electricity removing device 18. The charging device 12 charges a peripheral surface (image carrying surface) of the photoconductor drum 11, on which an image may be formed, to a certain potential. The exposure device 13 irradiates the charged peripheral surface of the photoconductor drum 11 with light LB based on image information (signal) to form an electrostatic latent image (for the corresponding color) having a potential difference. The developing device 14 (S1, S2, Y, M, C, or K) forms a toner image by developing the electrostatic latent image with toner contained in the developer 4 of the corresponding color (S1, S2, Y, M, C, or K). The first transfer device 15 performs a first transfer process in which the toner image is transferred onto the intermediate transfer device 20. The pre-cleaning charging device 16 charges substances, such as toner, that remain on the image carrying surface of the photoconductor drum 11 after the first transfer process. The drum cleaning device 17 cleans the image carrying surface by removing the recharged substances. The electricity removing device 18 removes electricity from the image carrying surface of the photoconductor drum 11 after the cleaning process.

The photoconductor drum 11 includes a cylindrical or columnar base member that is grounded and a photoconductive layer (photosensitive layer) that is provided on the peripheral surface of the base member. The photoconductive layer is made of a photosensitive material and is provided with the image carrying surface. The photoconductor drum 11 is supported so as to be capable of rotating in the direction shown by arrow A when power is transmitted thereto from a rotation driving device (not shown).

The charging device 12 is a non-contact charging device, such as a corona discharger, and is arranged without contacting the photoconductor drum 11. The charging device 12 includes a discharge member that receives a charging voltage. In the case where the developing device 14 performs reversal development, a voltage or current having the same polarity as the charging polarity of the toner supplied by the developing device 14 is supplied as the charging voltage.

The exposure device 13 forms the electrostatic latent image by irradiating the charged peripheral surface of the photoconductor drum 11 with light (arrowed dashed line) LB generated in accordance with the image information input to the image forming apparatus 1. When forming the electrostatic latent image, the exposure device 13 receives the image information (signal) that is input to the image forming apparatus 1 by any method.

As illustrated in FIG. 2, each developing device 14 (S1, S2, Y, M, C, or K) includes a housing 140 having an opening and a chamber of the developer 4. Two developing rollers 141 and 142, two stirring-and-transporting members 143 and 144, and a layer-thickness regulating member 145 are disposed in the housing 140. The two developing rollers 141 and 142 hold the developer 4 and transport the developer 4 to respective developing areas in which the developing rollers 141 and 142 face the photoconductor drum 11. The stirring-and-transporting members 143 and 144 are, for example, two screw augers that transport the developer 4 while stirring the developer 4 so that the developer 4 passes between the developing rollers 141 and 142. The layer-thickness regulating member 145 regulates the amount (layer thickness) of the developer 4 held by the developing roller 142. A developing voltage supplied from a power supply device (not shown) is applied between the photoconductor drum 11 and the developing rollers 141 and 142 of the developing device 14. The developing rollers 141 and 142 and the stirring-and-transporting members 143 and 144 receive power from a rotation driving device (not shown) and rotates in a certain direction. Two-component developers containing nonmagnetic toner and magnetic carrier are used as the developers 4 (Y, M, C, and K) of the above-described four colors and the developers 4 (S1 and S2) of the two special colors.

The first transfer device 15 is a contact transfer device including a first transfer roller which rotates while contacting the peripheral surface of the photoconductor drum 11 and receives a first transfer voltage. A direct-current voltage having a polarity opposite to the charging polarity of the toner is supplied as the first transfer voltage from the power supply device (not shown).

As illustrated in FIG. 2, the drum cleaning device 17 includes a container-shaped body 170 that has an opening, a cleaning plate 171, a rotating brush roller 172, and a transporting member 173. The cleaning plate 171 is arranged to contact the peripheral surface of the photoconductor drum 11 at a certain pressure after the first transfer process and clean the peripheral surface of the photoconductor drum 11 by removing substances such as residual toner therefrom. The rotating brush roller 172 is arranged to contact with the peripheral surface of the photoconductor drum 11 while rotating at a position upstream of the cleaning plate 171 in the rotation direction of the photoconductor drum 11. The transporting member 173 is, for example, a screw auger that transports the substances such as toner that have been removed by the cleaning plate 171 to a collecting system (not shown). The cleaning plate 171 may be formed of a plate-shaped member (for example, a blade) made of rubber or the like.

As illustrated in FIG. 1, the intermediate transfer device 20 is disposed below the imaging devices 10 (S1, S2, Y, M, C, and K). The intermediate transfer device 20 basically includes an intermediate transfer belt 21, plural belt support rollers 22 to 27, a second transfer device 30, and a belt cleaning device 28. The intermediate transfer belt 21 rotates in the direction shown by arrow B while passing through a first transfer position, which is between the photoconductor drum 11 and the first transfer device 15 (first transfer roller). The belt support rollers 22 to 27 retain the intermediate transfer belt 21 in a desired position at the inner surface of the intermediate transfer belt 21 so that the intermediate transfer belt 21 is rotatably supported. The second transfer device 30 is disposed to oppose the belt support roller 26 that supports the intermediate transfer belt 21 at the outer-peripheral-surface (image-carrying-surface) side of the intermediate transfer belt 21. The second transfer device 30 performs a second transfer process in which the toner images on the intermediate transfer belt 21 are transferred onto the sheet of recording paper 5. The belt cleaning device 28 cleans the outer peripheral surface of the intermediate transfer belt 21 by removing substances such as toner and paper dust that remain on the outer peripheral surface of the intermediate transfer belt 21 after the intermediate transfer belt 21 has passed the second transfer device 30.

The intermediate transfer belt 21 may be, for example, an endless belt made of a material obtained by dispersing a resistance adjusting agent, such as carbon black, in a synthetic resin, such as polyimide resin or polyamide resin. The belt support roller 22 serves as a driving roller. The belt support rollers 23, 25, and 27 serve as driven rollers for retaining the position of the intermediate transfer belt 21. The belt support roller 24 serves as a tension-applying roller. The belt support roller 26 serves as a back-up roller in the second transfer process.

As illustrated in FIG. 1, the second transfer device 30 includes a second transfer belt 31 and plural support rollers 32 to 36. The second transfer belt 31 rotates in the direction shown by arrow C while passing through a second transfer position, which is on the outer-peripheral-surface side of the intermediate transfer belt 21 that is supported by the belt support roller 26 in the intermediate transfer device 20. The support rollers 32 to 36 retain the second transfer belt 31 in a desired position at the inner surface of the second transfer belt 31 so that the second transfer belt 31 is rotatably supported. The second transfer belt 31 is, for example, an endless belt having substantially the same structure as that of the above-described intermediate transfer belt 21. The belt support roller 32 is arranged so that the second transfer belt 31 is pressed at a certain pressure against the outer peripheral surface of the intermediate transfer belt 21 supported by the belt support roller 26. The belt support roller 32 serves as a driving roller, and the belt support roller 36 serves as a tension-applying roller. The belt support roller 32 of the second transfer device 30 or the belt support roller 26 of the intermediate transfer device 20 receives a direct-current voltage having a polarity that is opposite to or the same as the charging polarity of the toner as a second transfer voltage.

The fixing device 40 includes a heating rotating body 42 and a pressing rotating body 43 that are arranged in a housing 41 having an inlet and an outlet for the sheet of recording paper 5. The heating rotating body 42 includes a fixing belt that rotates in the direction shown by the arrow and that is heated by a heater so that the surface temperature thereof is maintained at a predetermined temperature. The pressing rotating body 43 is drum-shaped and contacts the heating rotating body 42 at a certain pressure substantially along the axial direction of the heating rotating body 42, so that the pressing rotating body 43 is rotated. In the fixing device 40, the contact portion in which the heating rotating body 42 and the pressing rotating body 43 contact each other serves as a fixing process unit that performs a certain fixing process (heating and pressing).

The paper feeding device 50 is disposed below the intermediate transfer device 20 and the second transfer device 30. The paper feeding device 50 basically includes at least one paper container 51 that contains sheets of recording paper 5 of the desired size, type, etc., in a stacked manner and a transporting device 52 that feeds the sheets of recording paper 5 one at a time from the paper container 51. The paper container 51 is, for example, attached to the housing 1*a* such that the paper container 51 may be pulled out therefrom at the front side (side that faces the user during operation) of the housing 1*a*.

Plural pairs of paper transport rollers 53 to 57, which transport each of the sheets of recording paper 5 fed from the paper feeding device 50 to the second transfer position, and a paper transport path including transport guide members (not shown) are provided between the paper feeding device 50 and the second transfer device 30. The pair of paper transport rollers 57 that are disposed immediately in front of the second transfer position on the paper transport path serve as, for example, registration rollers for adjusting the time at which each sheet of recording paper 5 is to be transported. A paper transport device 58, which may be belt-shaped, is provided between the second transfer device 30 and the fixing device 40. The paper transport device 58 transports the sheet of recording paper 5 that has been transported from the second transfer belt 31 of the second transfer device 30 after the second transfer process to the fixing device 40. A pair of paper discharge rollers 59 are disposed near a paper outlet formed in the housing 1*a*. The pair of paper discharge rollers 59 discharge the sheet of recording paper 5 that has been subjected to the fixing process and transported from the fixing device 40 to the outside of the housing 1*a*.

The image input device 60, which is provided when the image forming apparatus 1 is formed as a color copier, is an image reading device that reads an image of a document 6 having the image information to be printed. The image input device 60 is arranged, for example, above the housing 1*a* as illustrated in FIG. 1. The image input device 60 basically includes a document receiving plate (platen glass) 61, a light source 62, a reflection mirror 63, a first reflection mirror 64, a second reflection mirror 65, an image reading element 66, and an imaging lens 67. The document receiving plate 61 includes, for example, a transparent glass plate on which the document 6 having the image information to be read is placed. The light source 62 irradiates the document 6 placed on the document receiving plate 61 while moving. The reflection mirror 63 receives reflected light from the document 6 and reflects the light in a predetermined direction while moving together with the light source 62. The first and second reflection mirrors 64 and 65 move at a predetermined speed by a predetermined distance with respect to the reflection mirror 63. The image reading element 66 includes, for example, a charge coupled device (CCD) that receives and reads the reflected light from the document 6 and converts the reflected light into an electrical signal. The imaging lens 67 focuses the reflected light on the image reading element 66. Referring to FIG. 1, the document receiving plate 61 is covered by an opening-closing covering part 68.

The image information of the document 6 that has been read by the image input device 60 is input to an image processing device 70, which subjects the image information to necessary image processing. The image input device 60 transmits the read image information of the document 6 to the image processing device 70 as, for example, red (R), green (G), and blue (B) three-color image data (for example, 8-bit data for each color). The image processing device 70 subjects the image data transmitted from the image input device 60 to predetermined image processing, such as shading correction, misregistration correction, brightness/color space conversion, gamma correction, frame erasing, and color/movement edition. The image processing device 70 converts the image signals obtained as a result of the image processing into image signals of the above-described four colors (Y, M, C, and K), and transmits the image signals to the exposure device 13. The image processing device 70 also generates image signals for the two special colors (S1 and S2).

Operation of Image Forming Apparatus

A basic image forming operation performed by the image forming apparatus 1 will now be described.

First, an image forming operation for forming a full-color image by combining toner images of four colors (Y, M, C, and K) by using the four imaging devices 10 (Y, M, C, and K) will be described.

When the image forming apparatus 1 receives command information of a request for the image forming operation (printing), the four imaging devices 10 (Y, M, C, and K), the intermediate transfer device 20, the second transfer device 30, and the fixing device 40 are activated.

In each of the imaging devices 10 (Y, M, C, and K), first, the photoconductor drum 11 rotates in the direction shown by arrow A and the charging device 12 charges the surface of the photoconductor drum 11 to a certain potential with a certain polarity (negative polarity in the present exemplary embodiment). Subsequently, the exposure device 13 irradiates the charged surface of the photoconductor drum 11 with the light LB based on the image signal obtained by converting the image information input to the image forming apparatus 1 into a component of the corresponding color (Y, M, C, or K). As a result, an electrostatic latent image for the corresponding color having a certain potential difference is formed on the surface of the photoconductor drum 11.

After that, each of the developing devices 14 (Y, M, C, and K) supplies the toner of the corresponding color (Y, M, C, or K), charged with a certain polarity (negative polarity), from the developing rollers 141 and 142 to the electrostatic latent image of the corresponding color formed on the photoconductor drum 11. The toner electrostatically adheres to the electrostatic latent image, so that the electrostatic latent image is developed. As a result of the developing process, the electrostatic latent images for the respective colors formed on the photoconductor drums 11 are visualized as toner images of the four colors (Y, M, C, and K) developed with the toners of the respective colors.

When the toner images of the respective colors formed on the photoconductor drums 11 of the imaging devices 10 (Y, M, C, and K) reach the respective first transfer positions, the first transfer devices 15 perform the first transfer process so that the toner images of the respective colors are successively transferred, in a superimposed manner, onto the intermediate transfer belt 21 of the intermediate transfer device 20 that rotates in the direction of arrow B.

In each imaging device 10, after the first transfer process, the pre-cleaning charging device 16 recharges the substances, such as toner, that remain on the surface of the photoconductor drum 11 after the first transfer process. Subsequently, the drum cleaning device 17 cleans the surface of the photoconductor drum 11 by scraping off the recharged substances, and the electricity removing device 18 removes the electricity from the cleaned surface of the photoconductor drum 11. Thus, the imaging device 10 is set to a standby state for the next imaging operation.

In the intermediate transfer device 20, the intermediate transfer belt 21 rotates so as to transport the toner images that have been transferred onto the intermediate transfer belt 21 by the first transfer process to the second transfer position. The paper feeding device 50 feeds a sheet of recording paper 5 to the paper transport path in accordance with the imaging operation. In the paper transport path, the pair of paper transport rollers 57, which serve as registration rollers, transport the sheet of recording paper 5 to the second transfer position in accordance with the transfer timing.

At the second transfer position, the second transfer device 30 performs the second transfer process in which the toner images on the intermediate transfer belt 21 are simultaneously transferred onto the sheet of recording paper 5. In the intermediate transfer device 20 after the second transfer process, the belt cleaning device 28 cleans the surface of the intermediate transfer belt 21 by removing the substances, such as toner, that remain on the surface after the second transfer process.

The sheet of recording paper 5, onto which the toner images have been transferred by the second transfer process, is released from the intermediate transfer belt 21 and from the second transfer belt 31 and transported to the fixing device 40 by the paper transport device 58. In the fixing device 40, the sheet of recording paper 5 after the second transfer process is guided through the contact portion between the heating rotating body 42 and the pressing rotating body 43 that rotate. Thus, a fixing process (heating and pressing) is performed so that the unfixed toner images are fixed to the sheet of recording paper 5. In the case where the image forming operation is performed to form an image only on one side of the sheet of recording paper 5, the sheet of recording paper 5 that has been subjected to the fixing process is discharged to, for example, a discharge container (not illustrated) disposed outside the housing 1*a* by the paper discharge rollers 59.

As a result of the above-described operation, the sheet of recording paper 5 on which a full-color image is formed by combining toner images of four colors is output.

Next, the case will be described in which special-color toner images are additionally formed by using the developers of the special colors S1 and S2 in the above-described normal image forming operation performed by the image forming apparatus 1.

In this case, first, the imaging devices 10S1 and 10S2 perform an operation similar to the imaging operation performed by the imaging devices 10 (Y, M, C, and K). Accordingly, special-color toner images (S1 and S2) are formed on the photoconductor drums 11 of the imaging devices 10S1 and 10S2. Subsequently, similar to the manner in which the toner images of the four colors are processed in the above-described image forming operation, the special-color toner images formed by the imaging devices 10S1 and 10S2 are transferred onto the intermediate transfer belt 21 of the intermediate transfer device 20 in the first transfer process. Then, in the second transfer process, the second transfer device 30 transfers the special-color toner images from the intermediate transfer belt 21 onto the sheet of recording paper 5 together with the toner images of the other colors. Lastly, the sheet of recording paper 5, onto which the special-color toner images and the toner images of the other colors have been transferred in the second transfer process, is subjected to the fixing process performed by the fixing device 40 and discharged to the outside of the housing 1*a*.

As a result of the above-described operation, the sheet of recording paper 5 is output on which the two special-color toner images overlap with a part or the entirety of the full-color image formed by combining the toner images of four colors together.

In the case where the image forming apparatus 1 is equipped with the image input device 60 and serves as a color copier, a basic image forming operation is performed as follows.

That is, in this case, when the document 6 is set to the image input device 60 and command information of a request for the image forming operation (copying) is input, the image input device 60 reads the document image from the document 6. The information of the read document image is subjected to the above-described image processing performed by the image processing device 70, so that the image signals are generated. The image signals are transmitted to the exposure devices 13 of the imaging devices 10 (S1, S2, Y, M, C, and K). Accordingly, each imaging device 10 forms an electrostatic latent image and a toner image based on the image information of the document 6. After that, an operation similar to the above-described image forming operation (printing) is performed and the sheet of recording paper 5 on which an image obtained by combining the toner images together is formed is output.

Structure of Glossiness Controller

The image forming apparatus 1, which is structured as described above, further includes a glossiness controller. The glossiness controller reduces the occurrence of differences (unevenness) in glossiness of an image formed on the sheet of recording paper 5, which serves as a recording medium, over the surface of the sheet of recording paper 5, the image being formed of the toner images of four colors, which are yellow (Y), magenta (M), cyan (C), and black (K). A part of the glossiness controller includes the imaging devices 10S1 and 10S2 that use two types of clear toners having different glossinesses.

The developers 4 (S1 and S2) of the special colors used in the imaging devices 10S1 and 10S2 may be, for example, two types of clear toners used to correct the differences in glossiness over the surface of the recording medium on which an image is formed by using the above-described four colors. More specifically, the developers 4 (S1 and S2) may be a developer 4 (S1) of a special color including a first glossiness-correcting clear toner having a relatively high glossiness and a developer 4 (S2) of a special color including a second glossiness-correcting clear toner having a relatively low glossiness. The imaging devices 10S1 and 10S2, which use the developers 4 (S1 and S2) of the special colors, form a part of a glossiness-controlling unit. Of the imaging devices 10, the imaging devices 10S1 and 10S2 are arranged at the most upstream positions along the moving direction of the intermediate transfer belt 21. The clear toners used in the imaging devices 10S1 and 10S2 are obtained by removing colorants from the yellow (Y), magenta (M), or cyan (C) color toner. The first glossiness-correcting clear toner having a relatively high glossiness and the second glossiness-correcting clear toner having a relatively low glossiness are formed by adjusting the amounts of crystalline polymer in the toners so that the toners form images having different glossinesses after the fixing process. When, for example, the amount of crystalline polymer in the yellow (Y), magenta (M), and cyan (C) color toners is 8 weight percent, the amount of crystalline polymer in the second glossiness-correcting clear toner having a relatively low glossiness may be set to, for example, 4 weight percent and the amount of crystalline polymer in the first glossiness-correcting clear toner having a relatively high glossiness may be set to, for example, 10 weight percent.

Figure 3:
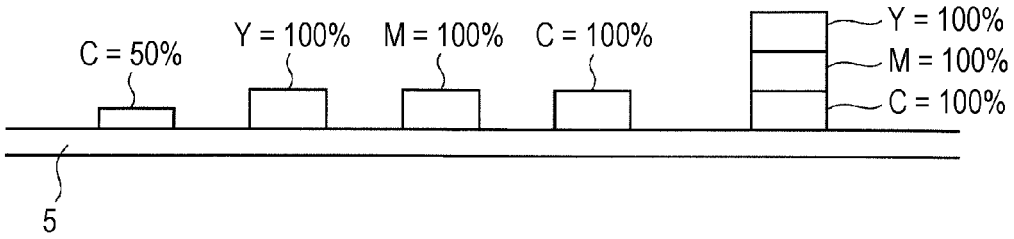
FIG. 3 is a schematic diagram illustrating a color toner image that has been transferred onto a sheet of recording paper.

Here, for example, coated paper (OKTC) having a basis weight of 127 gms is used as the sheet of recording paper 5, and images are formed by using toners of three colors, which are yellow (Y), magenta (M), and cyan (C) excluding black (K), while changing image densities Cin of the yellow (Y), magenta (M), and cyan (C) color toners in the range of 0% to 100%, as illustrated in FIG. 3. According to the experiments conducted by the present inventor, it has been found that the glossiness of the sheet of recording paper 5 after the toner images have been fixed thereto varies as in FIG. 4 in accordance with the total color-toner density Cin (%), which is the sum of the image densities of the color toners. To measure the glossiness of the color images, "Micro-gloss 4460" produced by BYK Gardner Inc. is used. The glossiness is measured at a measurement angle of 60°.

The full-color images formed on the sheet of recording paper 5, which is coated paper, have differences (unevenness) in glossiness in the range of about 30, which is the glossiness of the coated paper itself, to as high as about 80 over the surface of the recording paper 5. The glossiness varies in accordance with the total toner image density ΣCin, which is the sum of the image densities Cin of the toner images of three colors, which are yellow (Y), magenta (M), and cyan (C). Thus, the glossiness on the surface of the sheet of recording paper 5 largely varies, in other words, glossiness unevenness occurs, in accordance with the total toner density on the recording paper 5.

Accordingly, in this exemplary embodiment, the glossiness-controlling unit, which controls the glossiness on the surface of the sheet of recording paper 5 that has been subjected to the fixing process performed by the fixing device 40, is provided. The glossiness-controlling unit controls the glossiness by forming images of clear toners on the sheet of recording paper 5 in accordance with the total amount of toner in the color toner images to be transferred onto the sheet of recording paper 5.

Figure 5:
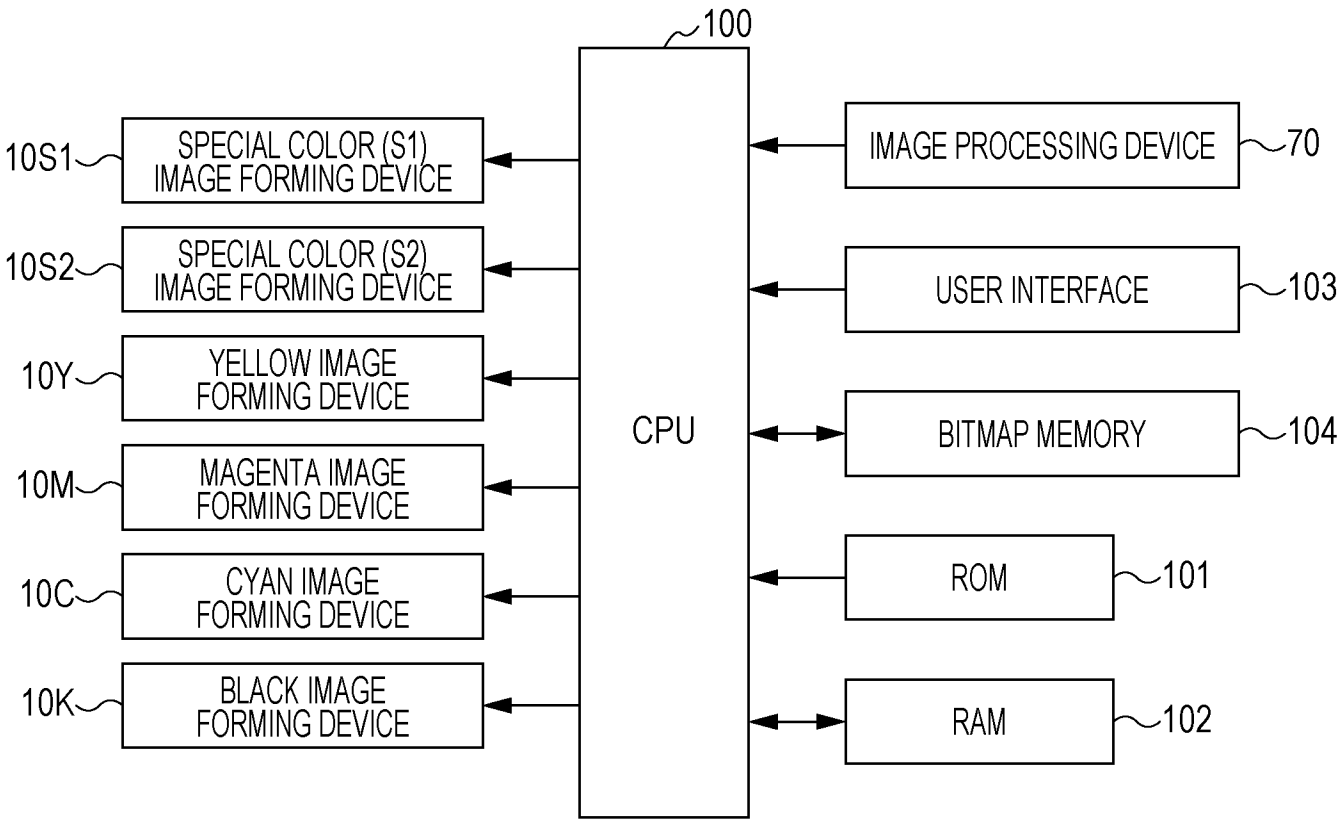
FIG. 5 is a block diagram of a control circuit of the image forming apparatus according to the exemplary embodiment of the present invention.

FIG. 5 is a block diagram illustrating a control circuit of the image forming apparatus 1.

Referring to FIG. 5, a central processing unit (CPU) 100 forms a part of the glossiness controller. The CPU 100 controls not only the overall image forming operation of the image forming apparatus 1 but also a clear-toner-image forming operation. In the clear-toner-image forming operation, amounts of toner in clear toner images, which are formed by the imaging devices 10 of the special colors S1 and S2 by using the clear toners, are calculated for each pixel and the clear toner images are formed accordingly. The CPU 100 controls the image forming operation and the clear-toner-image forming operation on the basis of programs stored in advance in a read only memory (ROM) 101 while referring as appropriate to parameters stored in a random access memory (RAM) 102.

The image processing device 70 receives image signals from a personal computer (not shown) or the image input device 60 and subjects the image signals to image processing.

A user may operate a user interface 103 to set the size and type of the sheet of recording paper 5 on which an image is to be printed or a desired value of glossiness in the process of printing an image on the sheet of recording paper 5.

The image signals of each page for yellow (Y), magenta (M), cyan (C), and black (K) toners are divided into pixels in a bitmap memory 104, the image signals being output from the image processing device 70. The bitmap memory 104 is, for example, provided for each color of yellow (Y), magenta (M), cyan (C), and black (K).

The six imaging devices 10S1, 10S2, 10Y, 10M, 10C, and 10K include the imaging devices 10S1 and 10S2 that respectively form the two types of toner images of the special colors S1 and S2 and the imaging devices 10Y, 10M, 10C, and 10K that respectively form the toner images of four colors, which are yellow (Y), magenta (M), cyan (C), and black (K).

Operation of Glossiness Controller

The operation of the glossiness controller will now be described.

Referring to FIG. 5, the image processing device 70 generates the image signals output to the exposure devices 13 included in the four imaging devices 10 (Y, M, C, K) for yellow (Y), magenta (M), cyan (C), and black (K).

Referring to FIG. 5, the CPU 100 calculates density information of the toner of each color for each pixel on the basis of the image signals output from the image processing device 70 to the exposure devices 13. When the image signals are output to the exposure devices 13 of the imaging devices 10 (Y, M, C, and K), the CPU 100 creates a bitmap in accordance with the image resolution by using the bitmap memory 104, as illustrated in FIGS. 6A and 6B, and determines the image density Cin(%) of each of the yellow (Y), magenta (M), and cyan (C) toners for each pixel G.

Figure 6A:
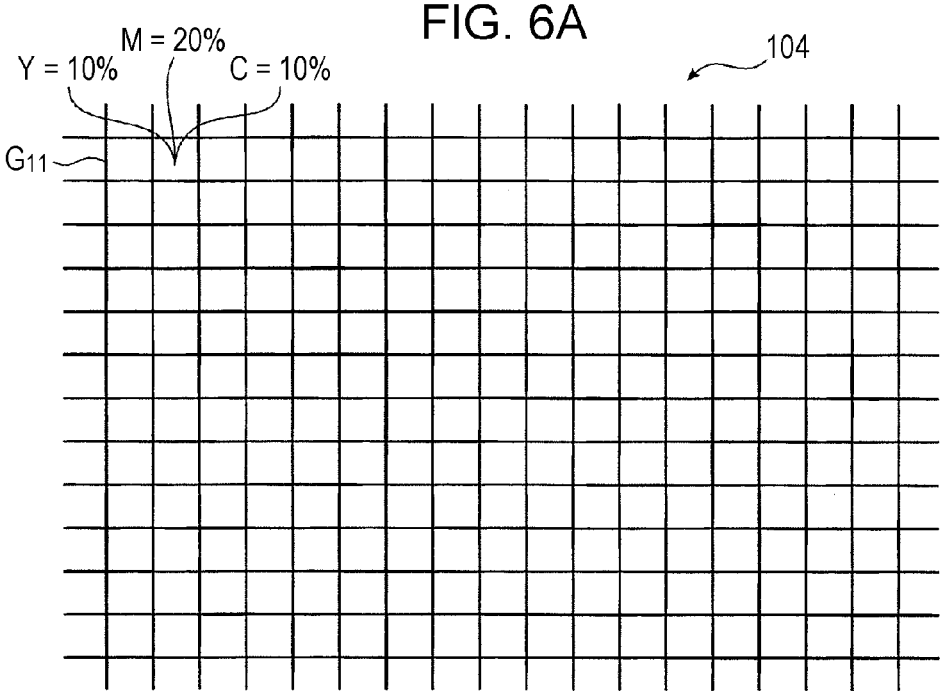
FIGS. 6A and 6B illustrate the contents of a bitmap memory.
Figure 6B:
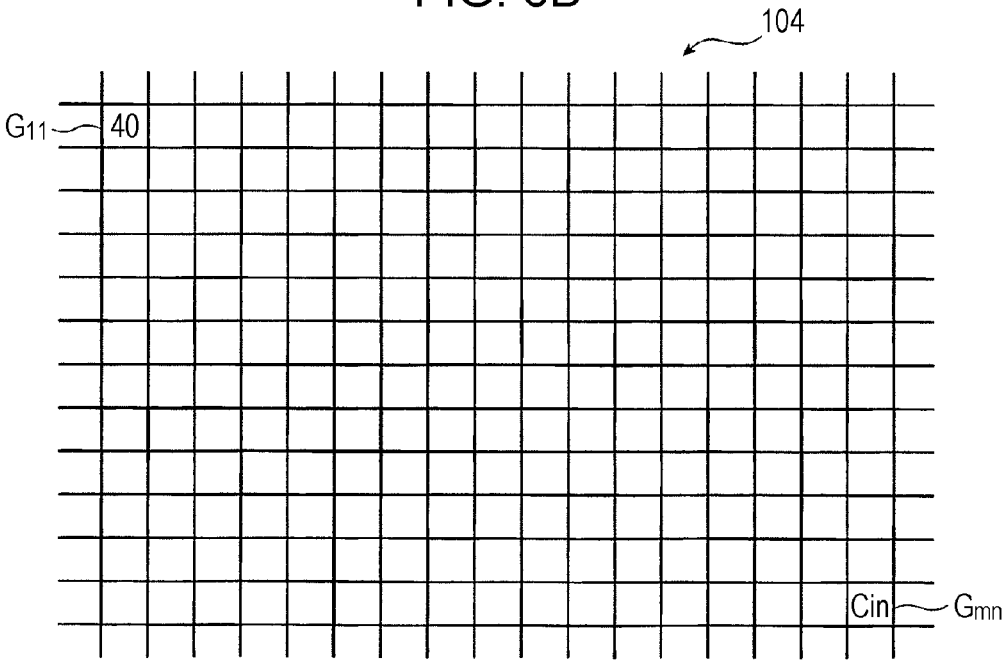

Referring to FIG. 6A, assume that the image densities Cin(%) of yellow (Y), magenta (M), and cyan (C) at the pixel $G_{11}$ in the first line and first column are Cin=10% for yellow (Y), Cin=20% for magenta (M), and Cin=10% for cyan (C). In this case, the total image density Cin(%) of yellow (Y), magenta (M), and cyan (C) at the pixel $G_{11}$ in the first line and first column is calculated as 10+20+10=40%, as illustrated in FIG. 6B. The CPU 100 calculates the total image densities $Cin_{11}$ to $Cin_{mn}$ (%) of color toners for all of the pixels G in each page of the recording paper 5.

Figure 11:
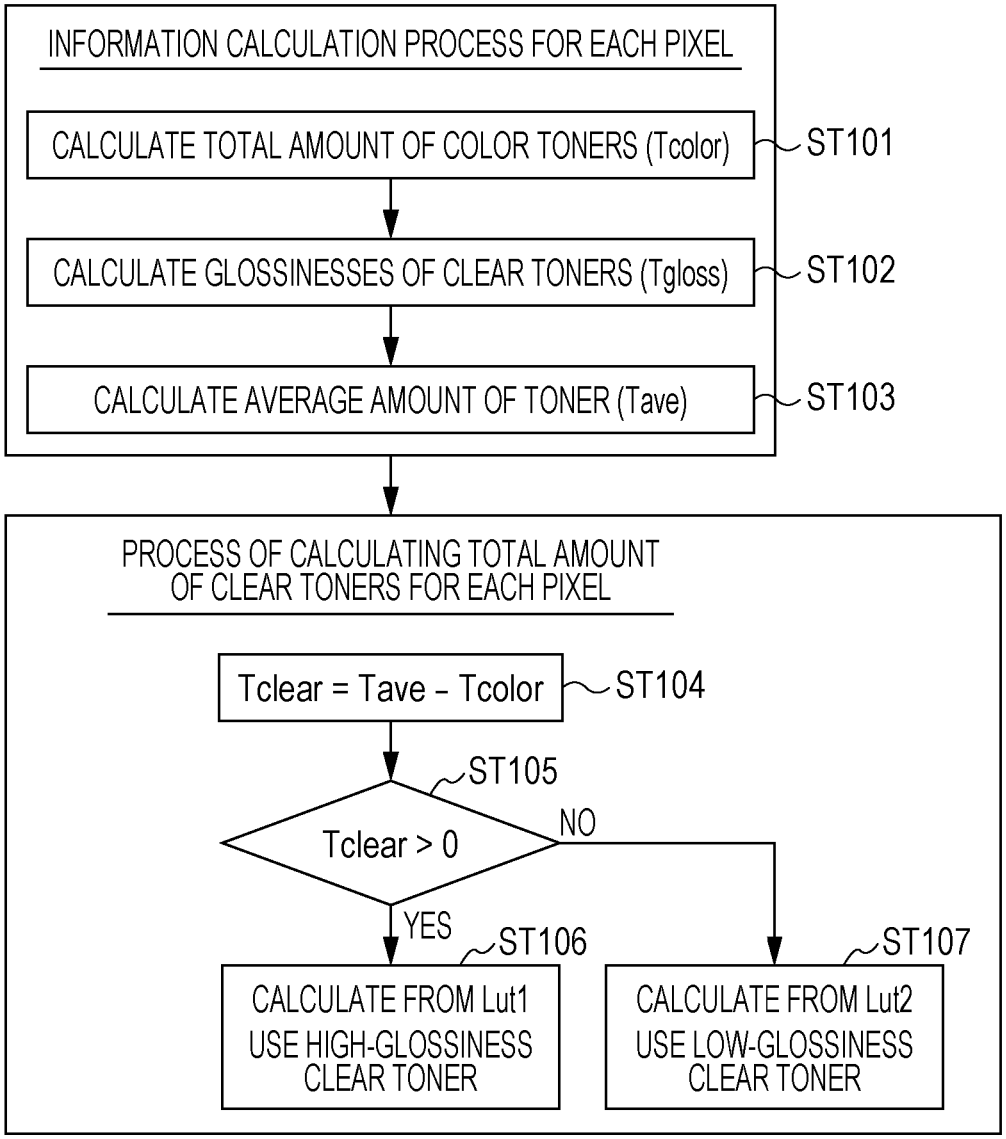
FIG. 11 is a flowchart illustrating the operation of the image forming apparatus according to the exemplary embodiment of the present invention.

Referring to FIG. 11, the CPU 100 refers to a look-up table (LUT) (not shown) and calculates the total amount of color toners (Tcolor) for each pixel on the basis of the total image density Cin(%) of yellow (Y), magenta (M), and cyan (C) (step 101). Calculations described below are performed for each pixel by the CPU 100.

When the total amount of color toners is determined, the CPU 100 refers to a graph or table (not shown) showing the relationship between the total amount of color toners and glossiness and calculates the glossiness obtained when the color toners are fixed to the sheet of recording paper 5 on the basis of the total image density Cin(%) of the color toners.

Figure 4:
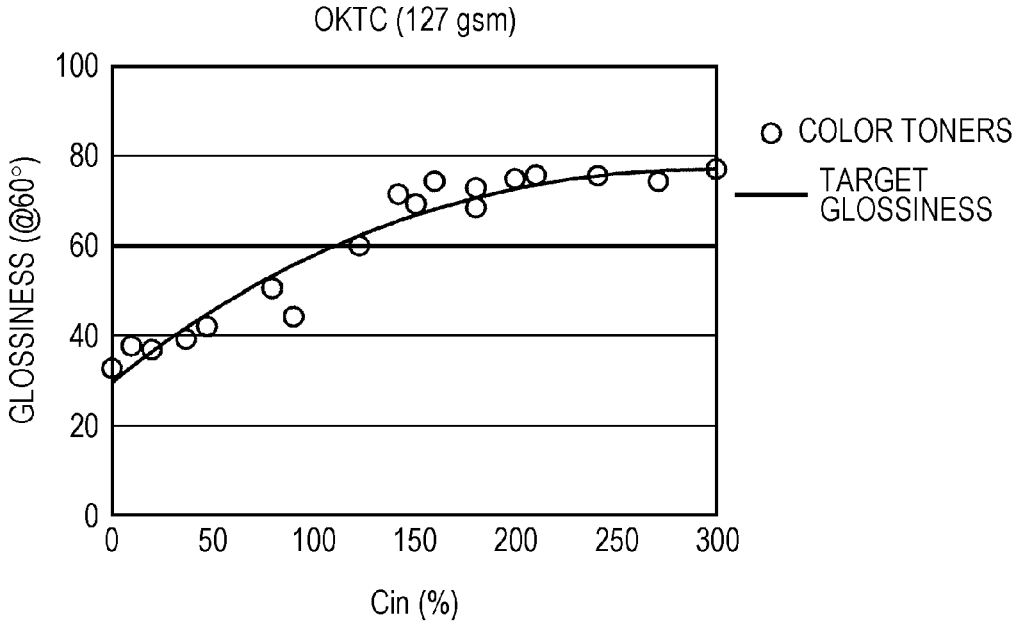
FIG. 4 is a graph showing the relationship between the total amount of color toners and glossiness.

The CPU 100 may determine the glossiness of the toner images fixed to the sheet of recording paper 5 directly on the basis of the total image density Cin(%) of the color toners, as illustrated in FIG. 4, without converting the total image density Cin(%) into the total amount of color toners.

Next, the CPU 100 determines the target glossiness of an image, such as a full-color image, formed by fixing the toner images to the sheet of recording paper 5. The target glossiness may either be set by the user through the user interface 103 or determined automatically by the CPU 100 on the basis of the glossiness of the sheet of recording paper 5 that is used. In the present exemplary embodiment, the recording paper 5 is OKTC paper, which is coated paper having a surface glossiness of about 30 and a basis weight of 127 gms. The target glossiness is set to 60, which is obtained by adding a predetermined value $\alpha$ (for example, 30) to the glossiness of the recording paper 5.

As illustrated in FIG. 11, the CPU 100 calculates the glossinesses (Tgloss) of the clear toners that are used (step 102), and also calculates the average amount of toner (Tave) in the toner images that form the image on the surface of the sheet of recording paper 5 (step 103).

In step 104 of FIG. 11, to achieve the target glossiness Ctarget (60), the CPU 100 calculates the total amount of clear toners (Tclear) for each pixel G by subtracting the total amount of color toners (Tcolor) from the average amount of toner (Tave) in the toner images that form the image on the surface of the sheet of recording paper 5 as follows:

$$Tclear = Tave - Tcolor$$

The CPU 100 determines whether the calculated total amount of clear toners Tclear is a positive value or a negative value (step 105). If the calculated total amount of clear toners Tclear is a positive value (Tclear>0), only the first clear toner having a relatively high glossiness is used. The amount of first clear toner to be used to achieve the target glossiness Ctarget is determined from a first look-up table (Lut1) illustrated in FIG. 12 (step 106).

If the calculated total amount of clear toners Tclear is less than or equal to zero, the CPU 100 uses only the second clear toner having a relatively low glossiness. The amount of second clear toner to be used to achieve the target glossiness Ctarget is determined from a second look-up table (Lut2) illustrated in FIG. 13 (step 107).

Figure 7:
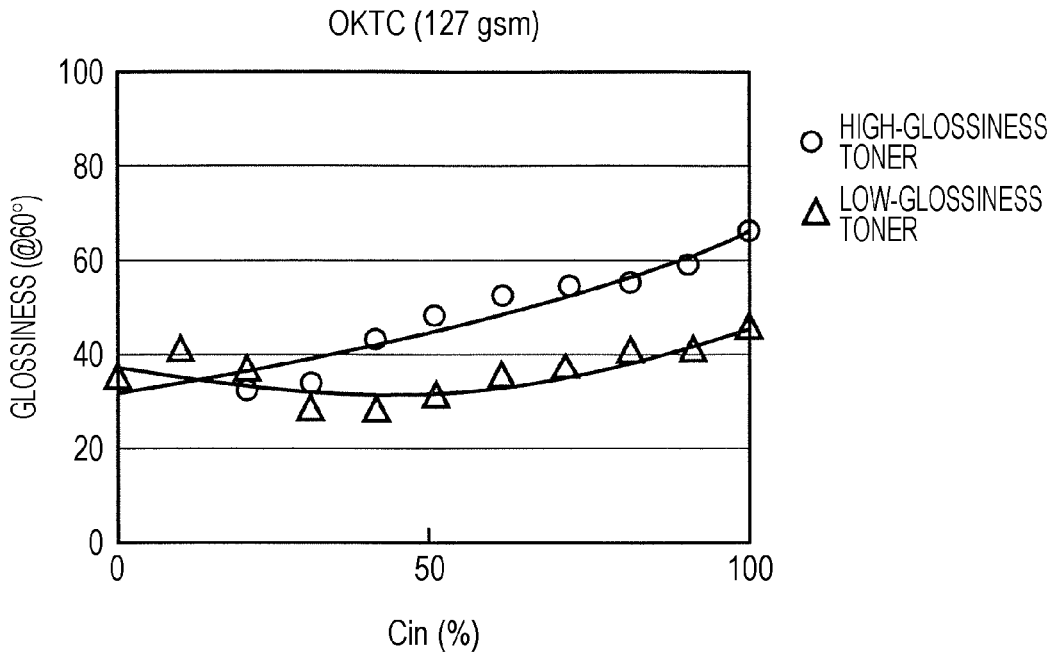
FIG. 7 is a graph showing the variation in glossiness caused by clear toners on a surface of a sheet of recording paper.

Here, assume that coated paper (OKTC paper) having a basis weight of 127 gms is used as the recording paper 5 and toner images that are formed using only the first high-glossiness clear toner and the second low-glossiness clear toner having different glossinesses are fixed to a sheet of recording paper 5. In this case, when the image densities Cin of the toners are varied in the range of 0% to 100%, the glossiness on the surface of the sheet of recording paper 5 varies, for example, as illustrated in FIG. 7. As the image density Cin of the first high-glossiness clear toner increases, the glossiness on the surface of the sheet of recording paper 5 increases from about 30 to about 70. As the image density Cin of the second low-glossiness clear toner increases, the glossiness on the surface of the sheet of recording paper 5 once decreases to about 30 or less. Then, when the image density Cin exceeds 50%, the glossiness on the surface of the sheet of recording paper 5 slightly increases to about 40.

Figure 8:
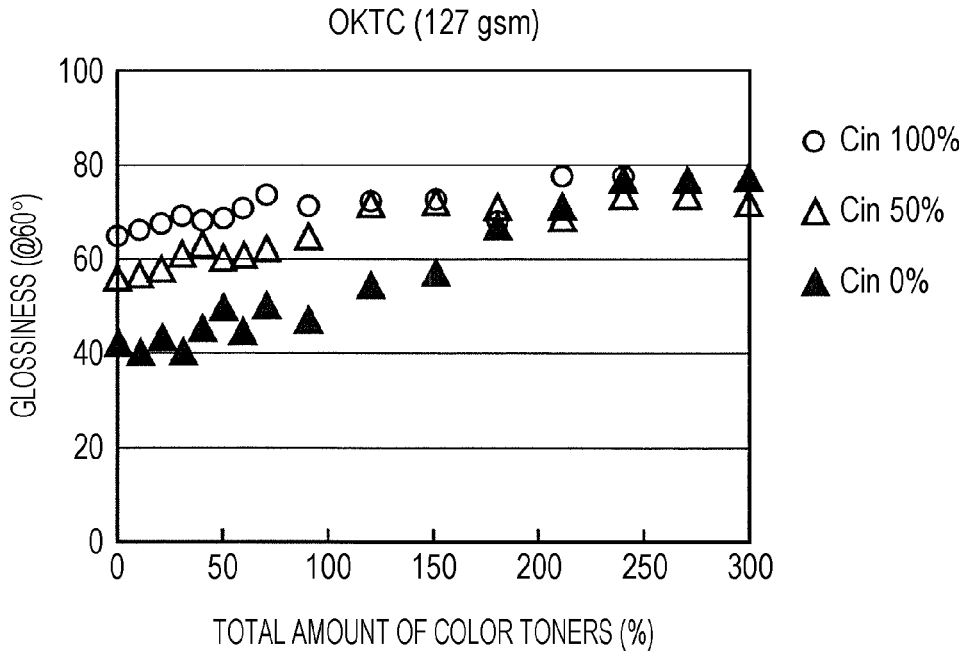
FIG. 8 is a graph showing the variation in glossiness caused by a high-glossiness toner on a surface of a sheet of recording paper.
Figure 9:
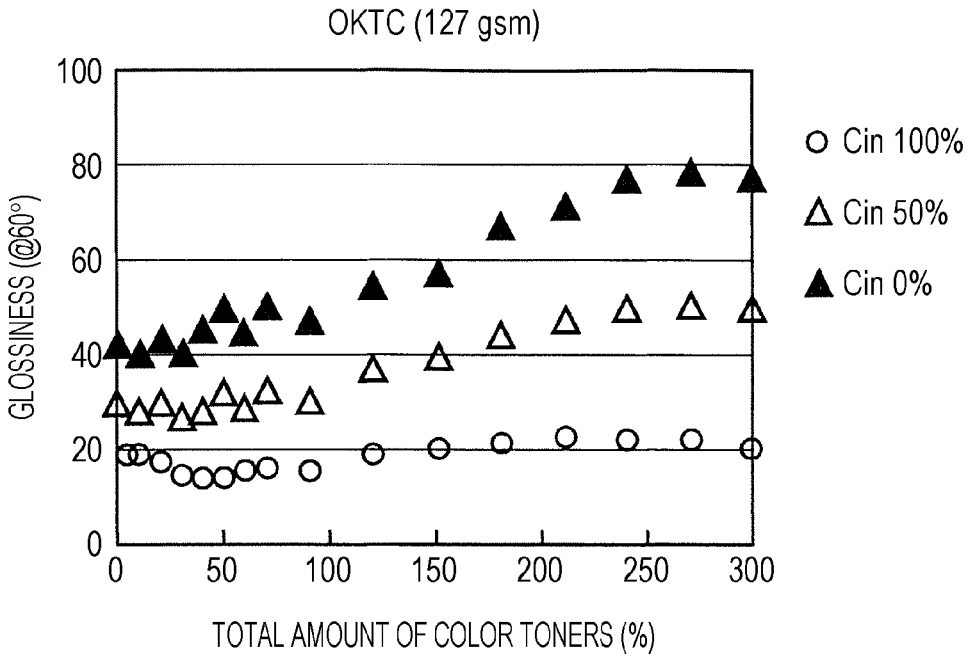
FIG. 9 is a graph showing the variation in glossiness caused by a low-glossiness toner on a surface of a sheet of recording paper.

In the case where the toner images formed by using the first high-glossiness clear toner and the second low-glossiness clear toner are superimposed on the toner images formed by using the color toners, the glossiness on the surface of the sheet of recording paper 5 varies, for example, as illustrated in FIGS. 8 and 9. In the case where the first high-glossiness clear toner is used, when Cin=0% and the first high-glossiness clear toner is not used, the glossiness on the surface of the sheet of recording paper 5 increases along with the total amount of color toners, as illustrated in FIG. 8. When the amount of first high-glossiness clear toner is increased to Cin=50% and Cin=100%, the glossiness is largely increased in accordance with the amount of high-glossiness clear toner in a low-density range in which the total amount of color toners is 100% or less. In a high-density range in which the total amount of color toners is 200% or more, the glossiness is maintained at a high level almost irrespective of the amount of high-glossiness clear toner.

In the case where the second low-glossiness clear toner is used, when Cin=0% and the second low-glossiness clear toner is not used, the glossiness on the surface of the sheet of recording paper 5 increases along with the total amount of color toners, as illustrated in FIG. 9. When the amount of second low-glossiness clear toner is increased to Cin=50% and Cin=100%, the glossiness is largely reduced as the amount of low-glossiness clear toner is increased to Cin=50% and Cin=100% in a high-density range in which the total amount of color toners is 150% or more. When the amount of second low-glossiness clear toner is Cin=100%, the glossiness may be set to approximately 20 irrespective of the total amount of color toners.

Referring to FIG. 6B, the bitmap memory 104 stores a bitmap of the image to be printed on the sheet of recording paper 5. The CPU 100 determines the amount of first clear toner and the amount of second clear toner for each pixel G of the image to be printed, and outputs image signals representing the amounts of first and second clear toners for each pixel G to the exposure devices 13 in the imaging devices 10 for the special colors S1 and S2. Then, the printing operation is started in the same manner as in the normal case.

The printing operation is performed as follows. That is, referring to FIG. 1, in the imaging device 10 for the special color S1 using the first clear toner having a relatively high glossiness, the surface of the photoconductor drum 11 is charged by the charging device 12, and is subjected to image exposure for each pixel G on the basis of the total amount of clear toners determined by the CPU 100. The electrostatic latent image formed on the surface of the photoconductor drum 11 is visualized by the developing device 14, and is transferred onto the intermediate transfer belt 21 in the first transfer process.

Next, in the imaging device 10 for the special color S2 using the second clear toner having a relatively low glossiness, the surface of the photoconductor drum 11 is charged by the charging device 12, and is subjected to image exposure for each pixel G on the basis of the total amount of clear toners determined by the CPU 100. The electrostatic latent image formed on the surface of the photoconductor drum 11 is visualized by the developing device 14, and is transferred onto the intermediate transfer belt 21 in the first transfer process.

Subsequently, the imaging devices 10 (Y, M, C, and K) for yellow (Y), magenta (M), cyan (C), and black (K) successively form the toner images of the respective colors, and the toner images are transferred onto the intermediate transfer belt 21 in a superimposed manner in the first transfer process.

Thus, the toner images of the respective colors, which are the special colors S1 and S2, yellow (Y), magenta (M), cyan (C), and black (K), are transferred onto the intermediate transfer belt 21 in a superimposed manner in the first transfer process. Subsequently, the toner images are simultaneously transferred onto the sheet of recording paper 5 from the intermediate transfer belt 21 at the second transfer position in the second transfer process. After that, the sheet of recording paper 5 is transported to the fixing device 40, where the fixing process using heat and pressure is performed, and discharged to the outside of the image forming apparatus 1 by the pair of paper discharge rollers 59.

Figure 10:
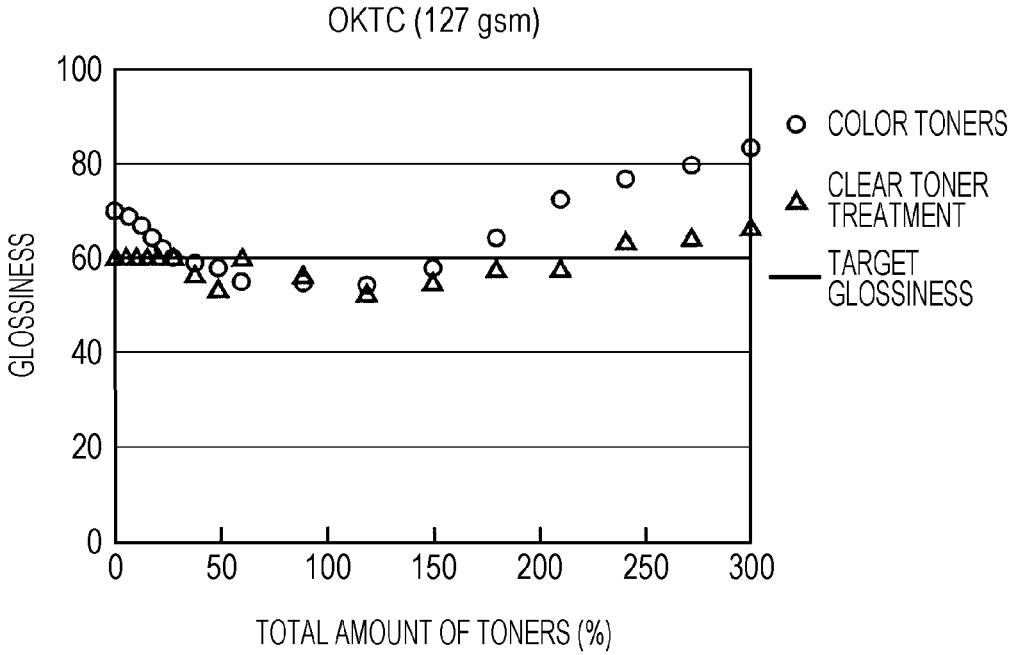
FIG. 10 is a graph showing the glossiness of an image formed by the image forming apparatus according to the exemplary embodiment of the present invention.

The glossiness of the thus-obtained full-color image is shown in FIG. 10. Referring to FIG. 10, in the pixel area in which the total amount of yellow (Y), magenta (M), and cyan (C) color toners is relatively large and the glossiness obtained when the color toners are fixed to the sheet of recording paper 5 is higher than the target glossiness, which is 60, a toner image is formed by using the second low-glossiness clear toner in accordance with the total amount of color toners. Thus, the glossiness in this pixel area is controlled to approximately 60.

In addition, referring to FIG. 10, in the pixel area in which the total amount of yellow (Y), magenta (M), and cyan (C) color toners is relatively small and the glossiness obtained when the color toners are fixed to the sheet of recording paper 5 is lower than or equal to the target glossiness, which is 60, a toner image is formed by using the first high-glossiness clear toner in accordance with the total amount of color toners. Thus, the glossiness in this pixel area is increased to approximately 60.

As is clear from FIG. 10, the glossiness of the full-color image is approximately 60 over the entire area of the surface of the sheet of recording paper 5. Thus, an image in which differences (unevenness) in glossiness are extremely small and which has appropriate glossiness characteristics may be formed on the surface of the sheet of recording paper 5. In a blank area in which no toner image is formed using the color toners and the total amount of color toners is around zero, the glossiness may be increased to approximately 60 by forming a toner image using the first high-glossiness clear toner.

In the above-described exemplary embodiment, two types of clear toners having different glossinesses are used. However, the number of types of clear toners used may, of course, instead be one.

In addition, in the above-described exemplary embodiment, a so-called tandem image forming apparatus which includes plural imaging devices is described. However, the image forming apparatus, of course, may instead be a so-called 4-cycle image forming apparatus including only one photoconductor drum.

In addition, in the above-described exemplary embodiment, the image forming apparatus includes an intermediate transfer device. However, the image forming apparatus may instead be structured such that the toner images are directly transferred onto a recording medium that is transported by a transport belt or the like. The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier that carries a first toner image;

a transfer unit that transfers the first toner image on the image carrier onto a recording medium directly or through an intermediate transfer body;

a fixing unit that fixes the first toner image that has been transferred onto the recording medium; and a glossiness-controlling unit that forms a second toner image made of clear toner on the recording medium in accordance with an amount of toner that forms the first toner image to be transferred onto the recording medium, thereby controlling a glossiness on a surface of the recording medium that has been subjected to the fixing performed by the fixing unit, wherein the clear toner comprises a crystalline polymer, wherein the glossiness-controlling unit uses two types of clear toners, including a first clear toner to form an image that has a high glossiness and a second clear toner to form an image that has a low glossiness, the low glossiness being of a lower glossiness than the high glossiness of the image formed using the first clear toner, and wherein the first clear toner has an amount in weight percent of crystalline polymer that is more than that of the second clear toner.

2. The image forming apparatus according to claim 1, wherein the first toner image includes a plurality of toner images that are made of respective color toners having different colors and transferred onto the intermediate transfer body in a superimposed manner, and wherein the glossiness-controlling unit determines the amount of the clear toner for each pixel on the basis of the total amount of the color toners, which is the sum of the amounts of the color toners, for each pixel.

3. The image forming apparatus according to claim 1, wherein a glossiness set as a target by the glossiness-controlling unit is arbitrarily settable by a user or is determined by using a glossiness of the recording medium as a reference.

4. An image forming method comprising:

transferring a first toner image that is carried by an image carrier onto a recording medium directly or through an intermediate transfer body;

fixing the first toner image that has been transferred onto the recording medium with a fixing unit; and forming a second toner image made of clear toner on the recording medium in accordance with an amount of toner that forms the first toner image to be transferred onto the recording medium, thereby controlling a glossiness on a surface of the recording medium that has been subjected to the fixing performed by the fixing unit, wherein the clear toner comprises a crystalline polymer, using two types of clear toners, including a first clear toner to form an image that has a high glossiness and a second clear toner to form an image that has a low glossiness, the low glossiness being of a lower glossiness than the high glossiness of the image formed using the first clear toner, and wherein the first clear toner has an amount in weight percent of crystalline polymer that is more than that of the second clear toner.

* * * * *